US011712592B2

(12) United States Patent
Jin

(10) Patent No.: US 11,712,592 B2
(45) Date of Patent: Aug. 1, 2023

(54) WETTING AGENT COMPOSITION FOR EXTINGUISHING FIRES

(71) Applicants: In Cheon Hwang, Seoul (KR); Su Lyeon Jin, Seoul (KR)

(72) Inventor: Su Lyeon Jin, Seoul (KR)

(73) Assignees: In Cheon Hwang, Seoul (KR); Su Lyeon Jin, Seoul (KR)

( * ) Notice: Subject to any disclaimer, the term of this patent is extended or adjusted under 35 U.S.C. 154(b) by 106 days.

(21) Appl. No.: 17/429,064

(22) PCT Filed: Feb. 10, 2020

(86) PCT No.: PCT/KR2020/001804
§ 371 (c)(1),
(2) Date: Aug. 6, 2021

(87) PCT Pub. No.: WO2020/166900
PCT Pub. Date: Aug. 20, 2020

(65) Prior Publication Data

US 2022/0126150 A1 Apr. 28, 2022

(30) Foreign Application Priority Data

Feb. 11, 2019 (KR) ..... 10-2019-0015772

(51) Int. Cl.
*A62D 1/00* (2006.01)

(52) U.S. Cl.
CPC ..... *A62D 1/0042* (2013.01); *A62D 1/0057* (2013.01)

(58) Field of Classification Search
None
See application file for complete search history.

(56) References Cited

FOREIGN PATENT DOCUMENTS

| | | | | |
|---|---|---|---|---|
| CN | 106139498 | A | * | 11/2016 |
| CN | 106237577 | A | * | 12/2016 |
| CN | 107349552 | A | | 11/2017 |
| JP | H06-218075 | A | | 8/1994 |
| KR | 10-1300870 | B1 | | 8/2013 |
| KR | 10-1654579 | B1 | | 9/2016 |
| KR | 10-2017-0037417 | A | | 4/2017 |
| KR | 10-2043750 | B1 | | 11/2019 |

OTHER PUBLICATIONS

International Search Report from corresponding PCT Application No. PCT/KR2020/001804, dated May 25, 2020.
Office Action from corresponding Chinese Patent Application No. 202080013510.6, dated Aug. 25, 2022.
Office Action from corresponding Chinese Patent Application No. 202080013510.6, dated Mar. 28, 2022.
Extended European Search Report from corresponding European Patent Application No. 20756089.7, dated Oct. 10, 2022.

* cited by examiner

*Primary Examiner* — Joseph D Anthony
(74) *Attorney, Agent, or Firm* — Harness, Dickey & Pierce, P.L.C.

(57) ABSTRACT

The present invention relates to a wetting extinguishing agent composition, comprising a metal carbonate; urea; a freezing point lowering agent; a fluorine-based surfactant; an amphoteric surfactant; and water, wherein the wetting extinguishing agent composition has excellent extinguishing ability not only for Class A fires, which are general fires, and Class B fires, which are oil-based fires, but also for Class K fires, which are kitchen fires.

7 Claims, No Drawings

WETTING AGENT COMPOSITION FOR EXTINGUISHING FIRES

CROSS-REFERENCE TO RELATED APPLICATIONS

This application is a national phase application of PCT Application No. PCT/KR2020/001804, filed on 10 Feb. 2020, which claims the benefit and priority to Korean Patent Application No. 10-2019-0015772, filed on 11 Feb. 2019. The entire disclosures of the applications identified in this paragraph are incorporated herein by references.

TECHNICAL FIELD

The present invention relates to a wetting extinguishing agent composition.

BACKGROUND ART

As human civilization develops and evolves, petrochemical products are widely used for convenience and comfort of life, and are susceptible to fire because the population lives in a dense form. In addition, when fire occurs, it expands to a large-sized fire, and damage to life and property is severe. However, it is not possible to replace all flammable substances used in daily life with nonflammable substances or flame retardant substances.

Therefore, in all countries, it is legislated that extinguishers be provided at dangerous facilities or hazardous material storage facilities, and some extinguishers have problems of lack of extinguishing ability and environmental damage due to toxicity.

Natural materials release a calorific value of 5600 kcal when 1 kg is burned, whereas petrochemicals generate a high heat of 12200 kcal when 1 kg is burned. After three minutes of fire, it is impossible to extinguish the fire by lowering the ignition point with water from the fire engine, and smoke particles also cause damage to people and livestock.

Extinguishing agents refer to solid, liquid, and gaseous substances having extinguishing performance, and among them, the liquid extinguishing agent includes a foam extinguishing agent, an acid alkali extinguishing agent, a reinforced liquid extinguishing agent, or a wetting extinguishing agent.

According to the approval criteria for an extinguishing agent, the reinforced liquid extinguishing agent among the liquid extinguishing agents must be an aqueous solution containing an alkali metal salt as a main component, exhibit an alkaline reaction, not have an acidic hydrogen ion concentration (pH) of 5.5 or less, and have a freezing point of −20° C. A reinforced liquid extinguishing agent is suitable for a general fire, which is a Class A fire and an oil-based fire, which is a Class B fire. Since the reinforced liquid extinguishing agent is a strong alkaline solution having a hydrogen ion concentration (pH) of 11 to 12, there are problems of corrosion of the container before and after use and secondary damage and stability by the chemical during use.

In recent years, products have been developed in which reinforced liquid extinguishing agents reduce the concentration of hydrogen ions to reduce secondary damage or inhibit corrosion of containers. Although the conventional Korean Patent Publication No. 10-2004-0078078 (published on 2004 Sep. 8) discloses a neutral reinforced liquid extinguishing agent having a low concentration of hydrogen ions, there is a problem that precipitation occurs during storage or a separation phenomenon of the chemical occurs.

Among the liquid extinguishing agents, the wetting extinguishing agent is a chemical used by mixing with water in order to increase water permeation ability, dispersing ability, emulsifying ability, etc. The wetting extinguishing agent has an advantage of being environmentally friendly as compared to the reinforced liquid extinguishing agent because the hydrogen ion concentration is neutral. In practice, a large number of wetting extinguishing agent products have been used for a general fire, which is a Class A fire, but the extinguishing effect is poor when applied to an oil-based fire, which is Class B fire. In addition, the wetting extinguishing agent has a problem in that the extinguishing effect is poor in a kitchen fire, which is a Class K fire.

SUMMARY

Technical Problem

The present invention is directed to providing a wetting extinguishing agent composition which can be used in a Class A fire, a Class B fire, and a Class K fire and has excellent extinguishing performance and is environmentally friendly in order to solve the above-mentioned problems.

However, the technical problem as described above is not limited, and other technical problems will be clearly understood by those skilled in the art to which the present invention belongs from the following description

Technical Solution

One embodiment of the present invention provides a wetting extinguishing agent composition comprising 5-15% by weight of a metal carbonate; 1-10% by weight of urea; 3-10% by weight of a freezing point lowering agent; 0.03-5% by weight of a fluorine-based surfactant; 0.5-10% by weight of an amphoteric surfactant; and 50-90% by weight of water.

In one embodiment of the present invention, the wetting extinguishing agent composition may comprise 5-10.9% by weight of a metal carbonate; 1-10% by weight of urea; 3-10% by weight of a freezing point lowering agent; 0.03-5% by weight of a fluorine-based surfactant; 0.5-10% by weight of an amphoteric surfactant; and 76.7-90% by weight of water.

In one embodiment of the present invention, the composition may have a surface tension of less than 33 mN/m.

In one embodiment of the present invention, the composition may have a hydrogen ion concentration (pH) between 6 and 9 at a temperature of between 19.5° C. and 20.5° C.

In one embodiment of the present invention, the composition may not undergo solution separation at a temperature between 0° C. and 50° C.

In one embodiment of the present invention, the amphoteric surfactant may be one or more selected from the group consisting of lauramido propyl betaine, cocamido propyl betaine, meadowfoam amido propyl betaine, coco dimethyl carboxymethyl betaine, lauryl dimethyl carboxymethyl betaine, lauryl dimethyl carboxyethyl betaine, cetyl dimethyl carboxymethyl betaine, lauryl bis-(2-hydroxyethyl)-carboxymethyl betaine, oleyl dimethyl gamma-carboxypropyl betaine, lauryl bis-(2-hydroxypropyl)-carboxyethyl betaine, coco amido disodium 3-hydroxypropyl phosphobetaine, lauric myristic amido disodium 3-hydroxypropyl phosphobetaine, lauric myristic amido glyceryl phosphobetaine, lauric myristic amido carboxy disodium 3-hydroxypropyl phosphobetaine, sodium cocoyl sarcosinate, sodium cocoamphoacetate, disodium cocoamphodiacetate, ammonium cocoyl sarcosinate, sodium cocoamphopropionate, coco amido dimethyl propyl sultaine, stearyl-amido dimethyl propyl sultaine, laurylamido-bis-(2-hydroxyethyl) propylsultaine, coco amido propyl monosodium phosphitaine and lauric myristic amido propyl monosodium phosphitaine.

In one embodiment of the present invention, the fluorine-based surfactant may be a hydrocarbon-based surfactant containing a perfluoroalkyl group.

In one embodiment of the present invention, the fluorine-based surfactant may be one or more selected from the group consisting of perfluoroalkyl betaine, perfluoroalkylcarboxy betaine, perfluoroalkylsulfo betaine, perfluoroalkyl carboxylate, perfluoroalkyl sulfate, perfluoroalkyl phosphate, perfluoroalkyl phosphate, a perfluoroalkyl amine salt, a perfluoroalkyl triethyl ammonium salt, a perfluoroalkyl quaternary ammonium salt, perfluoroalkyl polyoxyethylene and perfluoroalkyl ester.

In one embodiment of the present invention, the metal carbonate may be one or more selected from the group consisting of potassium bicarbonate, potassium carbonate, sodium carbonate, magnesium carbonate, cobalt carbonate and sodium bicarbonate.

In one embodiment of the present invention, the freezing point lowering agent may be ethylene glycol, propylene glycol, polyethylene glycol or glycerin.

In one embodiment of the present invention, the composition may further comprise 0.03-2% by weight of additive(s).

In one embodiment of the present invention, the additive may be one or more selected from the group consisting of methanol, ethanol, isopropyl alcohol, methyl ethyl ketone, formamide, methyl formamide, acetamide, methylacetamide, dimethyl acetamide, methyl cellosolve, ethyl cellosolve, butyl cellosolve, diethylene glycol monobutyl ether, diethylene glycol monoethyl ether, ethylene carbonate, propylene carbonate, dimethyl sulfoxide, and acetonitrile.

In one embodiment of the present invention, the composition may further comprise 0.01-2% by weight of a pH adjusting agent.

In one embodiment of the present invention, the pH adjusting agent may be one or more selected from the group consisting of citric acid, malonic acid, maleic acid, gluconic acid, tannic acid, oxalic acid, tartaric acid, gluconic acid, malic acid, lactic acid, acetic acid, pectinic acid, fumaric acid, succinic acid, adipic acid, and salicylic acid.

One embodiment of the present invention provides a wetting extinguishing agent made of the aforementioned wetting extinguishing agent composition.

Advantageous Effects

The wetting extinguishing agent composition according to the present invention has excellent extinguishing ability against not only a Class A fire, which is a general fire, and a Class B fire, which is an oil-based fire, but also a Class K fire, which is a kitchen fire.

In addition, since the wetting extinguishing agent composition according to the present invention is easily decomposed into microorganisms when dropped into soil or water to turn into nitrogen, phosphoric acid, and potassium, it does not adversely affect the soil environment and can be used as a plant nutrient. Since the wetting extinguishing agent composition of the present invention has an advantage of being environmentally friendly, it has a great difference from a reinforced liquid extinguishing agent and a powder extinguishing agent which cause serious damage to the environment.

In addition, since the wetting extinguishing agent composition according to the present invention is a wetting chemical, it can be used in admixture with water, and thus it can have all advantages of a water-extinguishing agent. That is, there is an effect that the cooling effect of lowering the temperature of the ignition point is excellent.

In addition, there is an advantage that the oxygen-blocking effect on the flame source is excellent due to the ionizing action of generating hydrogen and absorbing oxygen to block oxygen necessary for ignition.

In addition, there is an advantage of blocking the oxygen from the flame source by continuously generating bubbles resistant to the flame.

DETAILED DESCRIPTION

Hereinafter, the present invention will be described in more detail.

As used herein, the term "and/or" is used in the sense of including at least one or more of the elements listed before and after.

The following specific structural to functional descriptions are merely illustrated to illustrate embodiments in accordance with the inventive concepts, which may be embodied in various forms and should not be construed as being limited to the embodiments described herein.

Certain embodiments are described in detail herein, as embodiments in accordance with the inventive concepts may have various modifications and may have different forms. It should be understood, however, that the examples in accordance with the inventive concepts are not intended to be limited to the particular disclosure, but include all modifications, equivalents, and alternatives falling within the spirit and scope of the invention.

The terminology used herein is for the purpose of describing particular embodiments only and is not intended to be limiting of the invention. The articles "a" and "an" include plural referents unless the context clearly dictates otherwise.

Unless defined otherwise, all terms used herein, including technical or scientific terms, have the same meaning as commonly understood by one of ordinary skill in the art to which this invention belongs. Terms such as those defined in commonly used dictionaries should be interpreted as having a meaning that is consistent with the meaning in the context of the relevant art and should not be interpreted in an idealized or overly formal sense unless expressly so defined in this specification.

In the present specification, the "wetting extinguishing agent" refers to a chemical used by mixing with water in order to increase the penetrating ability, dispersing ability and emulsifying ability of water. The "wetting aqueous solution" refers to an aqueous solution obtained by mixing the wetting extinguishing agent with water.

The term "general fire" as used herein refers to a fire where ash remains after burning of a common combustible material such as wood, fiber, paper, rubber, plastics, etc. The fire extinguishers adopted for a general fire are denoted 'A'.

As used herein, "oil-based fire (Class B fire)" refers to a fire that does not leave ash after burning oils such as flammable liquids, combustible liquids, petroleum greases, tars, oils, oil-based paints, solvents, lacquers, alcohols and flammable gases. The fire extinguishers adopted for an oil-based fire are denoted 'B'.

As used herein, the term "kitchen fire (Class K fire)" refers to a fire that occurs in cookware handling animal and plant oils in the kitchen. The fire extinguishers adopted for kitchen fires are denoted 'K'.

One embodiment of the present invention provides a wetting extinguishing agent composition comprising 5-15% by weight of a metal carbonate, 1-10% by weight of urea, 3-10% by weight of a freezing point lowering agent, 0.03-5% by weight of a fluorine-based surfactant, 0.5-10% by weight of an amphoteric surfactant, and 50-90% by weight of water.

In one embodiment of the present invention, the wetting extinguishing agent composition may comprise 5-10.9% by weight of a metal carbonate; 1-10% by weight of urea; 3-10% by weight of a freezing point lowering agent; 0.03-5% by weight of a fluorine-based surfactant; 0.5-10% % by weight of an amphoteric surfactant; and 76.7-90% by weight of water.

In one embodiment of the present invention, the composition may have a surface tension of less than 33 mN/m.

In one embodiment of the present invention, the composition may have a hydrogen ion concentration (pH) between 6 and 9, more specifically a pH between 7.5 and 8.5, at a temperature between 19.5° C. and 20.5° C. The composition of the present invention may have a pH in the range of 6 to 9, specifically a pH of 7.5 to 8.5, without a pH adjusting agent.

The pH adjusting agent may be one or more selected from the group consisting of citric acid ($C_6H_8O_7$), malonic acid ($C_3H_4O_4$), maleic acid ($C_4H_4O_4$), gluconic acid ($C_6H_{12}O_7$), tannic acid ($C_{76}H_{52}O_{46}$), oxalic acid ($C_2H_2O_4$), tartaric acid ($C_4H_6O_6$), gluconic acid ($C_6H_{12}O_7$), malic acid ($C_4H_6O_5$), lactic acid ($C_3H_8O_3$), acetic acid ($C_2H_4O_2$), fumaric acid ($C_4H_4O_4$), succinic acid ($C_4H_6O_4$), adipic acid ($C_6H_{10}O_4$) and salicylic acid ($C_7H_6O_3$).

In one embodiment of the present invention, the composition may not undergo solution separation at a temperature between 0° C. and 50° C. In addition, the wetting aqueous solution obtained by mixing the wetting extinguishing agent composition of the present invention with water may not undergo solution separation at a temperature of 0° C. to 50° C. When solution separation occurs, this is not suitable for a wetting extinguishing agent. The term "solution separation phenomenon" as used herein includes all similar phenomena such as precipitation, clouding, etc.

In one embodiment of the present invention, the metal carbonate may be included at 5 to 15% by weight based on the total weight of wetting extinguishing agent composition. When the content of the metal carbonate is less than 5% by weight, there is a problem that a precipitate is generated in the wetting extinguishing agent composition, and when the content is more than 15% by weight, alkalinity is strong, which is not suitable as a standard for a wetting extinguishing agent having a pH of 6 to 9, and thus extinguishing ability is inferior. The present invention has the advantage that the pH can be maintained in the range of 6-9 without a pH adjusting agent since the content of the metal carbonate is 5-15% by weight.

The metal carbonate is not particularly limited as long as it is a substance in which a carbonate and metal are bonded to each other, and may specifically be one or more selected from the group consisting of potassium bicarbonate ($KHCO_3$), potassium carbonate ($K_2CO_3$), sodium carbonate ($Na_2CO_3$), magnesium carbonate ($MgCO_3$), cobalt carbonate ($CoCO_3$) and sodium bicarbonate ($NaHCO_3$); more specifically, it may be potassium bicarbonate.

The metal carbonate decomposes by heat during a fire to produce hydrogen and carbon dioxide, and the generated carbon dioxide combines with oxygen to produce the effect of an ionizing action that reduces the oxygen concentration around the flame source. In addition, there is an effect of forming bubbles of the amphoteric surfactant to provide a strong extinguishing action and a suffocating action. When a phosphate, a sulfate, etc. other than a carbonate is used, a solution separation phenomenon such as formation of a precipitate may occur to deteriorate the extinguishing function, and it may be out of the pH range of 6-9 and may be unsuitable as a wetting extinguishing agent.

In one embodiment of the present invention, the urea may be included at 1-10% by weight based on the total weight of the wetting extinguishing agent composition. The urea can serve as a stabilizer and a freezing point lowering adjuvant. The urea helps to cool below the flash point. When ammonia is used instead of urea, a bad odor is generated, which is disadvantageous, and environmental problems can arise from a residue. When the content of the urea is less than 1% by weight, it is difficult to obtain a sufficient stabilizer or coolant effect, resulting in a solution separation phenomenon and a poor freezing point lowering effect. Further, when the content of urea is higher than 10% by weight, miscibility with other components is poor, and foamability and stability of foam are poor.

In one embodiment of the present invention, the freezing point lowering agent may be included at 3-10% by weight based on the total weight of the wetting extinguishing agent composition. When the content of the freezing point lowering agent is less than 3% by weight, the effect of lowering a freezing point is poor and the extinguishing agent is frozen, which is unsuitable. In addition, when the content of the freezing point lowering agent is more than 10% by weight, the freezing point lowering agent itself is burnt as an organic substance, which may cause a change in physical properties and increase flammability, resulting in a decrease in extinguishing ability. According to one embodiment of the present invention, the freezing point lowering agent may be ethylene glycol ($HO(CH_2)_2OH$), propylene glycol ($C_3H_8O_2$), polyethylene glycol ($H—[OCH_2CH_2]n-OH$) or glycerin ($C_3H_5O_3$).

In one embodiment of the present invention, the fluorine-based surfactant may be included at 0.03-5% by weight based on the total weight of wetting extinguishing agent composition. When the content of the fluorine-based surfactant is less than 0.03% by weight, the effect of lowering surface tension is slight, and when the content is more than 5% by weight, there is no increase in the effect for lowering surface tension due to the increase in content, and there is a problem that the surfactant is not dissolved and floating matter is generated, and since the price is high, it is not economically preferable.

In one embodiment of the present invention, the fluorine-based surfactant may be a hydrocarbon-based surfactant containing a perfluoroalkyl group, more specifically a hydrocarbon-based surfactant containing perfluoroalkyl group and still more specifically an amphoteric hydrocarbon-based surfactant containing perfluoroalkyl group. For example, the amphoteric fluorine surfactants including perfluoroalkyl betaine, perfluoroalkylcarboxy betaine or perfluoroalkylsulfo betaine; anionic fluorine surfactants including perfluoroalkylcarboxylate, perfluoroalkylsulfate, perfluoroalkyl phosphate or perfluoroalkylphosphate; cationic fluorine surfactants containing perfluoroalkyl amine salts, perfluoroalkyl triethyl ammonium salts or perfluoroalkyl quaternary ammonium salts; and nonionic fluorine surfactants such as perfluoroalkylpolyoxyethylene or perfluoroalkyl ester may be used alone or in combination of two or more.

The fluorine-based surfactant serves to lower the surface tension of the aqueous solution to improve the spreadability of the solution, and serves to preserve the foamed foam so as not to break on the liquid fuel. That is, it serves to prevent air bubbles from bursting in the flame to increase the extinguishing ability.

The fluorine-based surfactant has a function of lowering the surface tension of the extinguishing agent composition to less than 33 mN/m to allow the wetting extinguishing agent composition to easily penetrate into the deep portion of a burning substance, such as a deep fire, thereby effectively extinguishing the deep fire.

In one embodiment of the present invention, the amphoteric surfactant may be included at 0.5-10% by weight based on the total weight of the wetting extinguishing agent composition. When the content of the amphoteric surfactant is less than 0.5% by weight, the effect of lowering surface tension is slight, and when the content is more than 10% by weight, there is a problem that the surfactant is not dissolved and floating matter is generated.

The amphoteric surfactant may specifically be a non-fluorine-based amphoteric surfactant and contains one or more $C_8$-$C_{22}$ aliphatic substituents, which may include an anionic water-soluble group such as a carboxy group, a sulfonate group, or a sulfate group. For example, the amphoteric surfactant may be one or more selected from the group consisting of lauramido propyl betaine, cocamido propyl betaine, meadowfoam amido propyl betaine, coco dimethyl carboxymethyl betaine, lauryl dimethyl carboxymethyl betaine, lauryl dimethyl carboxyethyl betaine, cetyl dimethyl carboxymethyl betaine, lauryl bis-(2-hydroxyethyl)-carboxymethyl betaine, oleyl dimethyl gamma-carboxypropyl betaine, lauryl bis-(2-hydroxypropyl)-carboxyethyl betaine, coco amido disodium 3-hydroxypropyl phosphobetaine, lauric myristic amido disodium 3-hydroxypropyl phosphobetaine, lauric myristic amido glyceryl phosphobetaine, lauric myristic amido carboxy disodium 3-hydroxypropyl phosphobetaine, sodium cocoyl sarcosinate, sodium cocoamphoacetate, disodium cocoamphodiacetate, ammonium cocoyl sarcosinate, sodium cocoamphopropionate, coco amido dimethyl propyl sultaine, stearyl-amido dimethyl propyl sultaine, laurylamido-bis-(2-hydroxyethyl) propylsultaine, coco amido propyl monosodium phosphitaine and lauric myristic amido propyl monosodium phosphitaine. Specifically, lauramido propyl betaine is more effective.

The amphoteric surfactant serves as a foaming agent and has an effect of lowering surface tension, and the fluorine-based surfactant serves to prevent the air bubbles formed by the amphoteric surfactant and the air bubbles formed by the metal carbonate from bursting. Therefore, the amphoteric surfactant, in particular, the non-fluorine-based amphoteric surfactant and the fluorine-based surfactant, have the effect of increasing extinguishing ability by interacting with each other, so that they can extinguish not only Class A fires and Class B fires but also Class K fires, which are the basis of the extinguishing performance of the infiltrating extinguishing agent. Therefore, when only one of an amphoteric surfactant and a fluorine-based surfactant is included, the extinguishing performance may be poor, and the fire extinguishability in a Class B fire and a Class K fire may be poor. In addition, even in the case where a fluorine-based surfactant is not contained, and an amphoteric surfactant and a cationic surfactant are contained, the extinguishing performance in a Class B fire and a Class K fire may be poor.

The water itself has an extinguishing function and a function as a solvent for dissolving other components. The water is not particularly limited, and includes purified water and/or unpurified water. The water may be selected from, for example, tap water, ground water, distilled water and/or purified water, etc. Such water may be included at 50-90% by weight based on the total weight of the wetting extinguishing agent composition according to the present invention.

In one embodiment of the present invention, the composition may further comprise 0.03-2% by weight of additive(s). The additive may specifically be an organic solvent, and more specifically, may be one or more selected from group consisting of methanol ($CH_3OH$), ethanol ($C_2H_8O$), isopropyl alcohol ($C_3H_8O$), methyl ethyl ketone ($C_4H_8O$), formamide ($CH_3NO$), methylformamide ($C_2H_5NO$), acetamide ($C_2H_5NO$), N-methylacetamide ($C_3H_7NO$), dimethyl acetamide ($C_4H_9NO$), methyl cellosolve ($C_3H_8O_2$), ethyl cellosolve ($C_4H_{10}O_2$), butyl cellosolve ($C_6H_{14}O_2$), diethylene glycol monobutyl ether ($C_8H_{18}O_3$), diethylene glycol monoethyl ether ($C_6H_{14}O_3$), ethylene carbonate ($C_3H_4O_3$), propylene carbonate ($C_4H_6O_3$), dimethyl sulfoxide ($C_2H_6OS$) and acetonitrile ($C_2H_3N$). The additives may, more particularly, include ethanol, methyl ethyl ketone and isopropyl alcohol together.

The organic solvent additive serves to improve the function of lowering surface tension, and serves to make the fluorine-based surfactant be well mixed with the composition, to help prevent air bubbles from bursting in the flame, and to enhance the extinguishing function.

Furthermore, the wetting extinguishing agent according to the present invention may further comprise an additive in addition to the above ingredients. These additives can improve extinguishing performance and dispersion stability. In addition, it is possible to improve extinguishing performance by enhancing the cohesive force between the bubbles and preventing the bubble layer from breaking or flowing.

The wetting extinguishing agent composition according to the present invention can be applied to a Class A fire (general fires), a Class B fire (oil-based fires), as well as a Class K fire (kitchen fires).

The wetting extinguishing agent composition according to the present invention generates hydrogen upon fire extinguishing to absorb oxygen, and continuously generates bubbles resistant to the flame to block oxygen from the flame source, thereby exerting a strong extinguishing ability. In addition, it turns into nitrogen, phosphoric acid, and potassium after extinguishing, is harmless to the human body, does not contaminate soil, and is environmentally friendly.

EXAMPLES

The present invention will now be described in more detail by way of Examples, Comparative Examples and Experimental Examples. However, the following examples are intended to illustrate the present invention without limiting the scope thereof.

Example 1

A total of 340 ml of a wetting extinguishing agent composition was prepared by dissolving 10.9% by weight of potassium bicarbonate, 4.0% by weight of urea, 4.0% by weight of ethylene glycol, 2% by weight of lauramido propyl betaine, 0.1% by weight of perfluoroalkyl betaine, 0.14% by weight of ethanol, 0.03% by weight of methyl ethyl ketone, and 0.03% by weight of isopropyl alcohol in 78.9% by weight of water at 21° C. at a stirring speed of 180 rpm.

Example 2

A total of 340 ml of a wetting extinguishing agent composition was prepared by dissolving 5% by weight of potassium bicarbonate, 4.0% by weight of urea, 4.0% by weight of ethylene glycol, 3% by weight of lauramido propyl betaine, 0.5% by weight of perfluoroalkyl betaine, 0.7% by weight of ethanol, 0.15% by weight of methyl ethyl ketone and 0.15% by weight of isopropyl alcohol in 82.5% by weight of water at 21° C. at a stirring speed of 180 rpm.

Comparative Example 1

A total of 340 ml of a wetting extinguishing agent composition was prepared by dissolving 12.0% by weight of potassium bicarbonate, 2.0% by weight of urea, 3.0% by weight of ethylene glycol, and 0.1% by weight of cocamido propyl betaine in 82.9% by weight of water at 21° C. at a stirring speed of 180 rpm.

Comparative Example 2

A total of 340 ml of a wetting extinguishing agent composition was prepared by dissolving 5% by weight of potassium bicarbonate, 5.0% by weight of urea, 3.0% by weight of ethylene glycol, and 3.0% by weight of cocamido propyl betaine in 84.0% by weight of water at 21° C. at a stirring speed of 180 rpm.

Comparative Example 3

A total of 340 ml of a wetting extinguishing agent composition was prepared by dissolving 12.0% by weight of potassium bicarbonate, 8.0% by weight of urea, 2.0% by weight of ethylene glycol, and 1.0% by weight of lauramido propyl betaine in 77.0% by weight of water at 21° C. at a stirring speed of 180 rpm.

Comparative Example 4

A total of 340 ml of a wetting extinguishing agent composition was prepared by dissolving 10.0% by weight of potassium bicarbonate, 4.0% by weight of quaternary ammonium, 4.0% by weight of ethylene glycol, and 2.0% by weight of lauramido propyl betaine in 80.0% by weight of water at 21° C. at a stirring speed of 180 rpm.

Comparative Example 5

A total of 340 ml of a wetting extinguishing agent composition was prepared by dissolving 1.0% by weight of potassium bicarbonate, 2.0% by weight of sodium chloride, 8.0% by weight of ethylene glycol, 4.0% by weight of lauramido propyl betaine, and 1.0% by weight of ethyl cellulose in 84.0% by weight of water at 21° C. at a stirring speed of 180 rpm.

Comparative Example 6

A total of 340 ml of a wetting extinguishing agent composition was prepared by dissolving 10.0% by weight of potassium bicarbonate, 4.0% by weight of sodium chloride, 2.0% by weight of ethylene glycol, 2.0% by weight of lauramido propyl betaine, 0.1% by weight of perfluoroalkyl betaine, 0.14% by weight of ethanol, 0.03% by weight of methyl ethyl ketone and 0.03% by weight of isopropyl alcohol in 76.7% by weight of water at 21° C. at a stirring speed of 180 rpm.

Comparative Example 7

A total of 340 ml of a wetting extinguishing agent composition was prepared by dissolving 10.0% by weight of potassium bicarbonate, 4.0% by weight of sodium chloride, 4.0% by weight of ethylene glycol, 0.1% by weight of perfluoroalkyl betaine, 0.14% by weight of ethanol 0.14, 0.03% by weight of methyl ethyl ketone and 0.03% by weight of isopropyl alcohol in 81.7% by weight of water at 21° C. at a stirring speed of 180 rpm.

Comparative Example 8

A total of 340 ml of a wetting extinguishing agent composition was prepared by dissolving 10.0% by weight of potassium bicarbonate, 4.0% by weight of sodium chloride, 4.0% by weight of ethylene glycol, and 2.0% by weight of lauramido propyl betaine in 80.0% by weight of water at 21° C. at a stirring speed of 180 rpm.

Comparative Example 9

A total of 340 ml of a wetting extinguishing agent composition was prepared by dissolving 4.0% by weight of potassium bicarbonate, 4.0% by weight of sodium chloride, 4.0% by weight of ethylene glycol, 2.0% by weight of lauramido propyl betaine, 0.1% by weight of perfluoroalkyl betaine, 0.14% by weight of ethanol, 0.03% by weight of methyl ethyl ketone and 0.03% by weight of isopropyl alcohol in 85.7% by weight of water at 21° C. at a stirring speed of 180 rpm.

[Experimental Example 1] Extinguishing Test

An extinguishing test was carried out using an aerosol extinguishing device. The term "aerosol-extinguishing device" refers to an extinguishing device having an extinguishing ability unit of less than 1 defined by "Descriptive criteria for type approval and product inspection of fire extinguisher", which is one of the Fire Approval Criteria, the weight of the extinguishing agent is less than 0.7 kg, and the filling pressure in the extinguishing agent container filled in the extinguishing device is not more than 0.8 MPa (8 $kg/cm^2$) at (35±0.5) ° C. The term "extinguishing device" refers to an extinguishing apparatus filled with an extinguishing agent and used for extinguishing fires.

The compositions of Examples 1 and 2 and Comparative Examples 1 to 9 were filled in a can at 8 $kg/cm^2$ at a fixed high temperature (35° C.) and low temperature (−5° C.) and then subjected to an extinguishing test twice in the following five types, and the values are shown in Table 1 below.

1. Fire Extinguishing Testing of Wastebasket

A cylinder having an inner diameter of 2.8 cm is placed in the center portion of an iron cylinder having an inner diameter of 28 cm and a height of 30 cm, and 40 sheets (weight: about 240 g) of balled-up newspaper (the size is ¼ of regular paper, about 54 cm long and about 79 cm wide) are evenly packed and evenly stacked around the cylinder. 0.3 g of cotton wool is immersed in methyl alcohol suitable for KSM1658 (methyl alcohol (methanol)), then placed in a cylinder and subjected to burning, immediately followed by drawing off the cylinder and burning for 3 minutes, and in the case of after the extinguishing test, there should be no afterflame and no re-burning within 2 minutes. Extinguishment is determined when the above criteria are met.

2. Petroleum Furnace Fire

An iron box of width of 40 cm, length of 20 cm, and height of 50 cm is installed at the center of a fire model with a width of 70 cm, a length of 40 cm and a height of 2 cm, and the fire model is charged with 1 L of kerosene and 100 mL of normal heptane suitable for KSM 2613 (kerosene) No. 1 and burned, and then burned for 1 minute, and in the case of after the extinguishing test, there should be no afterflame and no re-burning within 1 minute. Extinguishment is determined when the above criteria are met.

3. Curtain Fire

The center portion of a thick curtain (acrylic 100%, weight of about 1.35 kg after being left to stand at a temperature of (50±2) ° C. for 24 hours) with a width of 190 cm and a height of 175 cm is bundled, the top of the curtain is set at 50 cm below the ceiling, 500 mL of water and 25 mL of normal heptane are put into a fire model with a width of 50 cm, a length of 10 cm and a height of 5 cm, and burned for 50 seconds, and in the case of after the extinguishing test, there should be no afterflame and no re-burning within 2 minutes. Extinguishment is determined when the above criteria are met.

4. Cushion Fire

A urethane foam (weight of about 1.3 kg) having a square shape with a side length of 100 cm and a thickness of 10 cm is kneaded with hexamethylenetetramine (weight: 0.15 g, diameter: 6.4 mm, and thickness: 4.3 mm) in the center portion, and then burned for 90 seconds, and in the case of after the extinguishing test, there should be no afterflame and no re-burning within 2 minutes. Extinguishment is determined when the above criteria are met.

5. Frying Pan Fire 700 mL of soybean oil (the ignition point is in the range of 360° C. or higher and up to 370° C.) is placed in a frying pan having a diameter of 30 cm and a height of 5 cm, heated to 400° C. with a gas stove, and then the gas stove was turned off, and in the case of after the extinguishing test, there should be no afterflame and no re-burning within 1 minute. Extinguishment is determined when the above criteria are met.

[Experimental Example 2] Measurement of pH

The pH measurements of the compositions of Examples 1 and 2 and Comparative Examples 1 to 9 were carried out and shown in Table 1. [Experimental Example 3] Measurement of Surface Tension The surface tensions of the compositions of Examples 1 and 2 and Comparative Examples 1 to 9 were measured and shown in Table 1. [Experimental Example 4] Measurement of Freezing Point The compositions of Examples 1 and 2 and Comparative Examples 1 to 9 were observed at a temperature of −5° C. for 240 hours, and whether or not the compositions were frozen was determined and shown in Table 1. [Experimental Example 5] Measurement of Solution Separation The compositions of Examples 1 and 2 and Comparative Examples 1 to 9 were observed at a temperature of 80° C. for 240 hours to determine whether or not a solution separation phenomenon occurred, and shown in Table 1 below. When a precipitate was generated or cloudy, it was determined as solution separation.

| Experimental Examples | | Example 1 | Example 2 | Comparative Example 1 | Comparative Example 2 | Comparative Example 3 | Comparative Example 4 |
|---|---|---|---|---|---|---|---|
| Experimental Example 1 (Extinguishing Test) | Wastebasket Fire | Extinguished | Extinguished | Extinguished | Extinguished | Extinguished | Extinguished |
| | Petroleum Furnace Fire | Extinguished | Extinguished | Not Extinguished | Extinguished | Extinguished | Not Extinguished |
| | Curtain | Extinguished | Extinguished | Extinguished | Extinguished | Extinguished | Extinguished |
| | Cushion | Extinguished | Extinguished | Extinguished | Extinguished | Extinguished | Extinguished |
| | Frying Pan | Extinguished | Not Extinguished | Not Extinguished | Extinguished | Not Extinguished | Not Extinguished |
| Experimental Example 2 | pH | 8.1 | 7.3 | 8.1 | 8.1 | 8.9 | 8.2 |
| Experimental Example 3 | Surface Tension (dyne/cm$^2$) | 26 | 22 | 33 | 36 | 33 | 29 |
| Experimental Example 4 | Freezing | | | | | Frozen | |
| Experimental Example 5 | Solution Separation Phenomenon | None | None | None | Severe | | Separation |

| Experimental Examples | | Comparative Example 5 | Comparative Example 6 | Comparative Example 7 | Comparative Example 8 | Comparative Example 9 |
|---|---|---|---|---|---|---|
| Experimental Example 1 (Extinguishing Test) | Wastebasket Fire | Extinguished | Extinguished | Extinguished | Extinguished | Extinguished |
| | Petroleum Furnace Fire | Not Extinguished | Extinguished | Not Extinguished | Not Extinguished | Not Extinguished |
| | Curtain | Extinguished | Extinguished | Extinguished | Extinguished | Extinguished |
| | Cushion | Extinguished | Extinguished | Extinguished | Extinguished | Extinguished |
| | Frying Pan | Barely extinguished | Extinguished | Not Extinguished | Barely extinguished | Not Extinguished |

-continued

| | | | | | | |
|---|---|---|---|---|---|---|
| Experimental Example 2 | pH | 8.1 | 8.1 | 8.4 | 8.1 | 7.4 |
| Experimental Example 3 | Surface Tension (dyne/cm$^2$) | 28 | 26 | 30 | 36 | 28 |
| Experimental Example 4 | Freezing | | Frozen | | | |
| Experimental Example 5 | Solution Separation Phenomenon | Separation | None | None | None | None |

With reference to Table 1, it can be confirmed that Example 1 has excellent extinguishing performance for general fires, oil-based fires and kitchen fires. In the case of Example 2, it can be confirmed that extinguishing performance is excellent for general fires, oil-based fires and kitchen fires.

In the case of Comparative Example 1, the surface tension was poor due to the absence of a fluorine-based surfactant and the presence of a small amount of an amphoteric surfactant, and fires in the petroleum fire model and frying pan fire model were not extinguished. In addition, the surface tension was 33 dyne/cm$^2$ such that it did not reach the criterion of less than 33 dyne/cm$^2$ for the wetting extinguishing agent.

In the case of Comparative Example 2, the solution separation phenomenon severely occurred at a high temperature of 80° C., and the surface tension was 36 dyne/cm$^2$ without containing a fluorine-based surfactant, and thus the criterion of the wetting extinguishing agent was not met.

In the case of Comparative Example 3, the composition contained a small amount of the freezing point lowering agent and a large amount of urea, resulting in the cooling action of the urea occurring and the composition freezing at −5° C. In addition, it does not contain a fluorine-based surfactant and contains a small amount of an amphoteric surfactant, such that it did not extinguish a fire in a frying fire model, and the surface tension was 33 dyne/cm$^2$, such that the criterion of the wetting extinguishing agent was not met.

In the case of Comparative Example 4, the composition did not contain a fluorine-based surfactant, and contained quaternary ammonium as a cationic surfactant, which did not extinguish a fire in a petroleum furnace fire model or a frying pan fire model, and since it contained no urea, a solution separation phenomenon occurred.

In the case of Comparative Example 5, there was no urea in the composition, the amount of potassium bicarbonate was very small, and no fluorine-based surfactant was contained, such that it did not extinguish a fire in the petroleum furnace fire model, and it was barely able to extinguish afire in the frying pan fire model. Solution separation phenomena also occurred by including sodium chloride and ethyl cellulose instead of urea.

In the case of Comparative Example 6, it can be confirmed that when the amount of ethylene glycol is small, freezing occurs at −5° C.

In the case of Comparative Example 7, no amphoteric surfactant was contained, foaming was less likely to occur, and extinguishing ability was poor, such that fires in the petroleum furnace fire model and frying pan fire model were not extinguished, and a solution separation phenomenon occurred.

In the case of Comparative Example 8, it was confirmed that the composition did not contain a fluorine-based surfactant and an additive, did not extinguish a fire in the petroleum furnace fire model, and barely extinguished a fire in the frying pan fire model. In addition, the surface tension increased, and the phenomenon of bubbles easily bursting occurred, and since a surface tension of 36 dyne/cm$^2$ was measured, the criterion of the wetting extinguishing agent was not met.

In the case of Comparative Example 9, it was confirmed that the content of the metal carbonate was low, foaming was small, and the amount of hydrogen generated was small such that oxygen blocking was not obtained, and fires were not extinguished in the petroleum furnace fire model and the frying pan fire model.

Having described a specific part of the present invention in detail above, it will be apparent to those skilled in the art that such specific description is only a preferred embodiment and is not intended to limit the scope of the invention. Accordingly, the substantial scope of the present invention will be defined by the appended claims and their equivalents.

What is claimed is:

1. An infiltrative extinguishing agent composition comprising:

5-10.9% by weight of a metal carbonate or metal bicarbonate;

1-8% by weight of urea;

3-10% by weight of a freezing point lowering agent;

0.03-5% by weight of a fluorine-based surfactant;

0.5-10% by weight of an amphoteric surfactant; and 76.7-90% by weight of water, wherein the composition has a hydrogen ion concentration (pH) of 6 to 9 at a temperature of 19.5° C. to 20.5° C., wherein the composition does not undergo solution separation at a temperature of 0° C. to 50° C., and wherein the amphoteric surfactant is one or more selected from the group consisting of lauramido propyl betaine, cocamido propyl betaine, meadowfoam amido propyl betaine, coco dimethyl carboxymethyl betaine, cetyl dimethyl carboxymethyl betaine, oleyl dimethyl gamma-carboxypropyl betaine, coco amido disodium 3-hydroxypropyl phosphobetaine,lauric myristic amido disodium 3-hydroxypropyl phosphobetaine, lauric myristic amido glyceryl phosphobetaine, lauric myristic amido carboxy disodium 3-hydroxypropyl phosphobetaine, sodium cocoyl sarcosinate, sodium cocoamphoacetate, disodium cocoamphodiacetate, ammonium cocoyl sarcosinate, sodium cocoamphopropionate, coco amido dimethyl propyl suitaine, stearyl-amido dimethyl propyl sultaine, laurylamido-bis-(2-hydroxyethyl) propylsultaine, coco amido propyl monosodium phosphitaine and lauric myristic amido propyl monosodium phosphitaine.

2. The infiltrative extinguishing agent composition according to claim 1, wherein the composition has a surface tension of less than 33 mN/m.

3. The infiltrative extinguishing agent composition according to claim 1, wherein the fluorine-based surfactant is a hydrocarbon-based surfactant containing a perfluoroalkyl group.

4. The infiltrative extinguishing agent composition according to claim 1, wherein the fluorine-based surfactant is one or more selected from the group consisting of perfluoroalkyl betaine, perfluoroalkylcarboxy betaine, perfluoroalkylsulfo betaine, perfluoroalkyl carboxylate, perfluoroalkyl sulfate, perfluoroalkyl phosphate, perfluoroalkyl phosphate, perfluoroalkyl amine salts, perfluoroalkyl triethyl ammonium salts, perfluoroalkyl quaternary ammonium salts, perfluoroalkyl polyoxyethylene and perfluoroalkyl ester.

5. The infiltrative extinguishing agent composition according to claim 1, wherein the metal carbonate or metal bicarbonate is one or more selected from the group consisting of potassium bicarbonate, potassium carbonate, sodium carbonate, magnesium carbonate, cobalt carbonate and sodium bicarbonate.

6. The infiltrative extinguishing agent composition according to claim 1, wherein the freezing point lowering agent is ethylene glycol, propylene glycol, polyethylene glycol or glycerin.

7. The infiltrative extinguishing agent composition according to claim 1, wherein the composition further comprises 0.03-2% by weight of additive(s), and the additive is one or more selected from the group consisting of methanol, ethanol, isopropyl alcohol, methyl ethyl ketone, formamide, methyl formamide, acetamide, methylacetamide, dimethyl acetamide, methyl cellosolve, ethyl cellosolve, butyl cellosolve, diethylene glycol monobutyl ether, diethyleneglycol monoethyl ether, ethylene carbonate, propylene carbonate, dimethyl sulfoxide, and acetonitrile.

* * * * *